US005476122A

United States Patent [19]

Schuster et al.

[11] Patent Number: 5,476,122

[45] Date of Patent: Dec. 19, 1995

[54] WEFT THREAD BRAKE RESPONSIVE TO YARN CHARACTERISTICS IN A LOOM

[75] Inventors: Rainer Schuster, Sigmarszell; Herbert Müller, Kressbronn, both of Germany

[73] Assignee: Lindauer Dornier Gesellschaft mbH, Lindau, Germany

[21] Appl. No.: 273,021

[22] Filed: Jul. 8, 1994

Related U.S. Application Data

[63] Continuation-in-part of Ser. No. 204,857, Mar. 2, 1994, Pat. No. 5,398,731.

[30] Foreign Application Priority Data

Jul. 15, 1993 [DE] Germany ..... 43 23 748.7

[51] Int. Cl.[6] ..... D03D 47/34

[52] U.S. Cl. ..... 139/194; 139/450

[58] Field of Search ..... 112/254, 255; 139/450, 194; 242/419.3, 419.4, 422, 422.1, 422.3

[56] References Cited

U.S. PATENT DOCUMENTS

| | | | |
|---|---|---|---|
| 3,633,711 | 1/1972 | Pfarrwaller | 242/149 |
| 3,797,426 | 3/1974 | Von Hagen | 242/150 M |
| 4,641,688 | 2/1987 | Gehring . | |
| 4,817,681 | 4/1989 | Krumm et al. . | |
| 5,002,098 | 3/1991 | Desmet et al. | 139/450 |
| 5,179,980 | 1/1993 | Hubner et al. | 139/450 |
| 5,305,966 | 4/1994 | Motta | 242/149 |

FOREIGN PATENT DOCUMENTS

| | | | |
|---|---|---|---|
| 0357975 | 3/1990 | European Pat. Off. | 139/194 |
| 0475892 | 3/1992 | European Pat. Off. . | |
| 0524429 | 1/1993 | European Pat. Off. . | |
| 2568595 | 2/1986 | France . | |

OTHER PUBLICATIONS

"Reduction the Weft Thread Load with the Aid of a Newly Developed, Closed Loop Controlled Weft Thread" by Wulfhorst et al., published in textil praxis international, 1991, vol. 12, pp. 1292–1297–no translation.

*Primary Examiner*—Andy Falik
*Attorney, Agent, or Firm*—W. G. Fasse; W. F. Fasse

[57] ABSTRACT

A weft thread brake for a loom has brake force application members controlled by a drive such as a high resolution stepping motor or a continuously adjustable drive for reducing or increasing a gap between the brake force application members. The weft thread moves through this gap. A thread tension sensor is arranged downstream of the brake and produces an actual thread tension signal that is used for producing in a closed loop unit, a brake force control signal for controlling the brake force in dependence on the actual thread tension signal. A rated weft thread tension value may be compared in the control unit with the measured actual weft thread tension signal and the result of this comparison is then used to produce the control signal to adapt the brake force to the thread characteristics and to maintain at all times during a weft thread insertion the required weft thread tension.

4 Claims, 1 Drawing Sheet

WEFT THREAD BRAKE RESPONSIVE TO YARN CHARACTERISTICS IN A LOOM

CROSS-REFERENCE TO RELATED APPLICATION

The present application is a continuation-in-part application of U.S. Ser. No. 08/204,857, filed on Mar. 2, 1994, entitled "WEFT THREAD BRAKE MECHANISM WITH A CONTROLLABLE BRAKING EFFECT", now U.S. Pat. No. 5,398,731, issue date May 21, 1995.

FIELD OF THE INVENTION

The invention relates to a weft thread brake for a loom. Such brakes comprise two braking members preferably two flexible brake lamellae forming a gap through which the weft thread is movable on its way into and through the loom shed. The brake force applied to the weft thread is responsive to yarn characteristics.

BACKGROUND INFORMATION

The above mentioned copending application Ser. No. 08/204,857 discloses a brake mechanism in which the brake force is controllable by a high resolution stepping motor which is substantially continuously variable for adjusting the gap width and thus the brake force applied to the weft thread. A programmable control unit which is preferably part of the central processing unit of the loom control is connected through signal transmitting data buses with the adjustment motor and with a dialog terminal also referred to as an input-output device. The content of U.S. Ser. No. 08/204,857 U.S. Pat. No. 5,398,731 is incorporated herein by reference.

It is known to adjust the weft thread brake in a loom in such a way that the tensile stress on the yarn or thread is optimal during insertion into the loom shed. Stated differently, efforts have been made to adapt the braking forces effective on the weft thread to the weft insertion conditions so that the weft tension should be optimal under these conditions which may, for example, be different in a shuttle loom or in a shutterless so-called gripper or rapier loom. These efforts aim at avoiding weft thread breaks on the one hand and to assure a proper weft thread insertion on the other hand. However, there is room for improvement.

European Patent Publication EPO 475,892 Al (Hübner et al.), published on Mar. 18, 1992 discloses a loom thread brake with a brake tape and a controllable brake member or body. In the known construction the weft thread is guided to pass through a gap between the brake tape and the brake body. The brake body is operated by an adjustment motor which in turn is controlled by a logic control circuit. The rotational movement of the adjustment motor is converted into a linear stroke movement of the brake body. A fixed control program is stored in the memory of the logic control circuit for each thread brake for producing a stroke curve that is optimally adapted to, for example, the yarn characteristics of the weft thread. The stroke curve indicates the position of the brake force applying surface of the brake body as a function of time. As a result, the stroke curve for each thread brake is determined by the respective fixed control program stored in the memory of the logic control circuit.

Such fixed control programs as disclosed in EP 0,475,892 Al, or rather the respective stroke curve of the thread brake and the corresponding characteristic of the brake action on the weft thread are not flexible and hence not optimally adaptable to the insertion conditions that present themselves during the duration of a weft thread insertion. These conditions may vary other the duration of a weft thread insertion and an adaptation to these variations is not possible according to Hübner et al. because a continuous comparing of a rated value with an actually sensed value of the weft thread tension is not provided in the just mentioned prior art. Thus, the known weft brake cannot react, for example, to irregularities occurring during a weft thread insertion. As a result, weft thread breaking is not avoided.

The thread brake according to EPO 475,892 Al is combined with a weft stop motion positioned at the weft exit side of the loom shed. It is the purpose of the weft stop motion to detect a weft thread break during the weft insertion. For this purpose, the weft thread monitor is connected to the central loom control to provide a broken weft thread representing signal to the central loom control. The central loom control stops the further weaving operation in response to such a weft thread break signal. It is a disadvantage of this prior art that the use of a weft stop motion at the exit side of the loom shed cannot be avoided because otherwise a weft thread break could not be detected.

OBJECTS OF THE INVENTION

In view of the above it is the aim of the invention to achieve the following objects singly or in combination:

- to construct a weft thread brake mechanism in such a way that its electrically controllable weft thread brake applies a brake force that is automatically adapted to the varying operating conditions of the weft thread insertion, especially the insertion velocity and to yarn characteristics;
- to provide for each phase of the weft thread insertion an optimal brake force applied to the weft thread;
- to construct the weft thread brake in such a way that the use of a weft stop motion on the weft thread insertion side of the loom shed can be avoided;
- to substantially avoid the occurrence of weft thread brakes by transporting the weft thread with just the right tension throughout its travel through the weft thread insertion channel in the loom shed; and
- to provide an internal adaptation of the control unit to the type of yarn being used in the weaving by comparing actual sensed values with rated stored values.

SUMMARY OF THE INVENTION

The above objects have been achieved according to the invention by the combination of an electrically controllable weft brake controlled by an electric motor responsive to a weft tension sensor arranged downstream of the brake as viewed in the travel direction of the weft thread and with a control unit that is connected to receive tension signals from the weft tension sensor and to also receive input signals from an input-output unit to generate or calculate a brake control signal for the drive of the weft brake to thereby control the brake force in accordance with the sensed actual tension signal or values and in accordance with rated stored signals or values from the memory of the control unit where the rated values were stored by the operator through the input-output unit which enables the storing of a control program in the control unit.

According to the invention the weft tension sensor downstream of the weft brake but upstream of the weft insertion channel, ascertains during each weft thread insertion the actual weft thread tension and supplies a respective signal or value to the control unit which is constructed as a closed loop control unit. The rated weft thread tension values stored in the memory are then compared with the continuously measured actual weft tension values or signals. The comparing is performed by a comparator which is part of the closed loop control unit, for each weft thread insertion or with reference to the main loom drive, whereby the weft tension actual value is correlated to the particular rotational angle of the loom main drive shaft and the comparing takes place with reference to such timing or with reference to the rotational angle of the loom main shaft. The closed loop control unit calculates from the comparing, the point of time at which a change in the brake force applied to the weft thread is to take place for the next following weft thread insertion.

The apparatus according to the invention achieves the advantage that the brake force applied by the weft brake to the weft thread is optimally adapted to the current or actual weft thread insertion conditions so that due to the comparing of the rated values with the actual values extreme weft thread tensions are avoided. As a result, the apparatus according to the invention maintains the correct weft thread tension or rather the required weft thread tension throughout a weft thread insertion duration. This features avoids the application of an excess tension to the weft thread, whereby weft thread breaks caused by excess tensions are avoided.

Another advantage of the invention is seen in that the continuous ascertaining of the actual weft thread tension by means of the tension sensor just downstream of the brake, provides information regarding a possible weft brake during the weft thread insertion. This information is provided by the fact that the sensor would indicate that the actual weft tension equals to zero signifying the presence of a weft break. As a result, the invention avoids the use of a highly sensitive weft stop motion at the inlet end of the weft insertion channel.

The avoidance of a weft stop motion is an important advantage because these conventional stop motions usually operate on the basis of the piezoelectric effect which can be influenced by extraneous occurrences in a weaving mill, e.g. vibrations or impacts. Conventional weft stop motions interpret these extraneous influences as a weft thread break even though an actual break may not have occurred. As a result, the loom is shut down when such shutting down is not intended or not necessary. The invention avoids this conventional problem.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
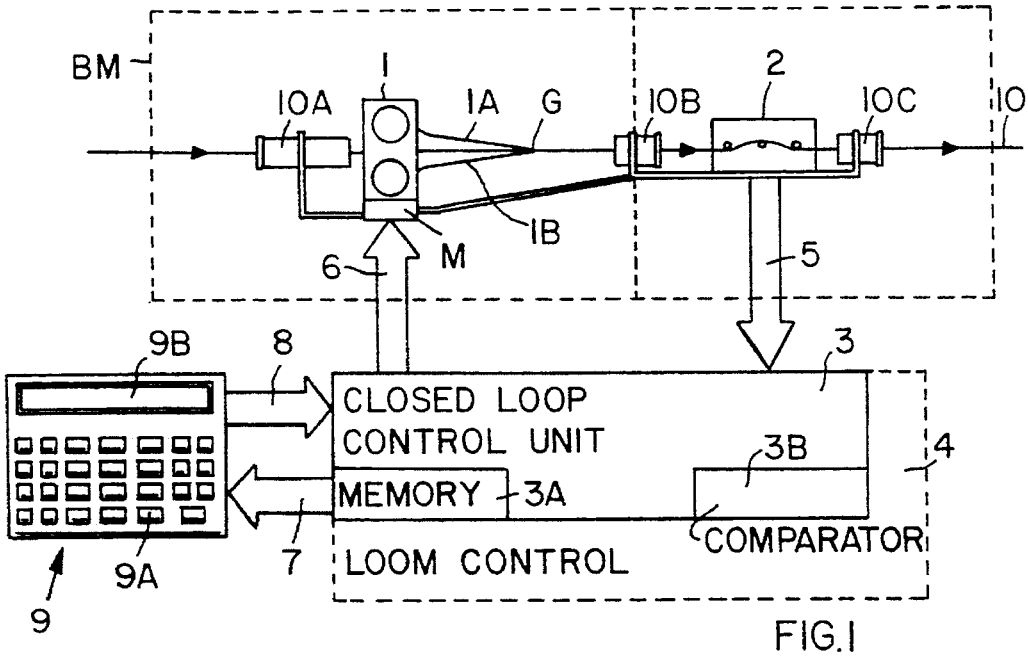
FIG. 1 is a schematic illustration of the closed loop control of a weft thread brake according to the invention.

FIG. 1 shows a brake mechanism BM according to the invention including a closed loop control unit 3 for controlling the brake force f. The mechanism BM includes three major components, namely the weft brake 1 with its electric control motor M, the weft thread tension monitor 2, and the closed loop control unit 3. The closed loop control unit 3 is preferably a component within the loom control 4. A weft thread 10 is guided from left to right by thread guides 10A, 10B, and 10C. The weft brake 1 has, for example, two brake members or elements in the form of blades or lamellae 1A and 1B that form a gap G through which the thread 10 must travel. The closed loop control unit 3 includes a memory 3A and a comparator 3B.

A data bus 5 connects the sensor 2 to the unit 3. A further databus 6 connects the closed loop control unit 3 with the electric motor M of the brake 1. A data bus 7 connects the unit 3 with an input-output device 9 also referred to as a dialog terminal having a keyboard 9A and a display 9B, e.g. for showing a thread break.

A further databus 8 connects thee dialog terminal 9 with the closed loop control unit 3.

The weft thread brake 1 is, for example, constructed as described in the above mentioned U.S. Ser. No. 08/204,857. While the use of the weft thread brake described in the just mentioned copending specification, is preferred, any other electrically controllable weft brake can be used for the present purposes.

The dialog terminal 9 with its keyboard 9A facilitates the entry of yarn specific parameters into the memory 3A. Such yarn specific parameters, for example, include a value representing the roughness of the particular yarn being used in the weaving and other similar parameters, such as the weft thickness. As a result, the closed loop control unit 3 is internally adapted by the operator to the yarn type being inserted by a respective operation of the keyboard 9A for the storing of corresponding rated values. Simultaneously, the operator inserts the rated value characteristic or curve for the tension force f as a function of the insertion time t of the weft thread into the loom shed or as a function of a degree of angular rotation of the loom main drive shaft. These values constitute rated values that are stored in the memory 3A of the closed loop control unit 3.

Figure 2:
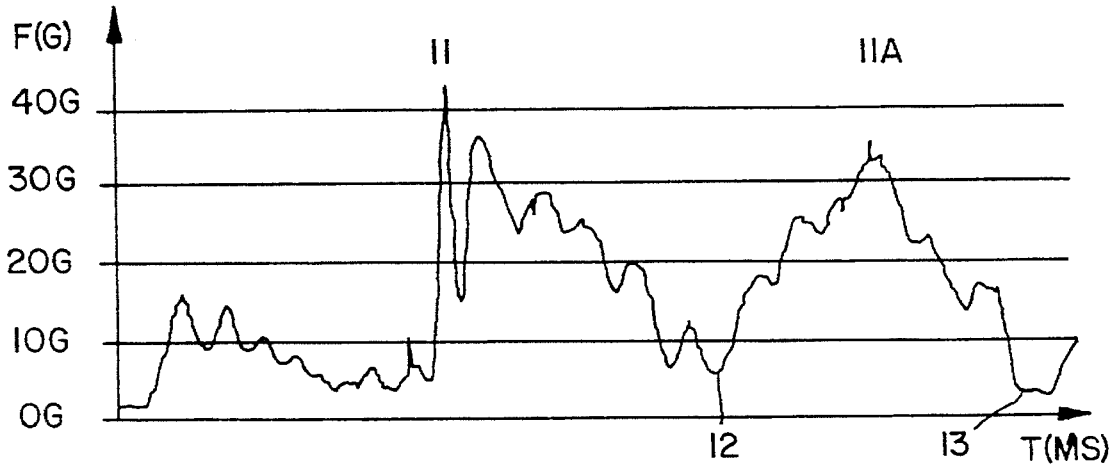
FIG. 2 is an oscillogram showing the tension force, more specifically, the brake force f in grams as a function of time in milliseconds during the duration of a weft thread insertion in a shuttleless loom.

FIG. 2 shows an oscillogram of a actual brake force f characteristic curve which is adequate for the yarn specific parameters or values that have been entered into the memory 3A. This curve constitutes a reference curve for all following weft thread insertions of the same yarn type. However, corrections are calculated when deviations between rated and actual values occur as is described below. The weft tension force f is shown in grams along the ordinate. The insertion time t is shown in milliseconds along the abscissa.

At the beginning of the weft thread insertion its tension is relatively low until a point 11 is reached in which the weft thread 10 is exposed to the maximum tension force. The tension force or brake force then diminishes until a first low point 12 is reached. At this point 12 the weft thread inserted by an insertion gripper is taken over by a withdrawal gripper in the center of the loom shed. The grippers are not shown, but are conventional in a shutterless loom. The tension then rises again to a second lower peak 11A from which it drops down to a second low point 13 where the weft thread tension becomes almost zero. Thus, point 13 represents the end of a weft thread insertion.

According to the invention the actual weft tension value sensed by the sensor 2 are provided to the comparator 3B in the unit 3 which compares the actual values with the rated or reference values shown in FIG. 2. The monitoring takes place continuously through the weft thread insertion time t to ascertain those points of time at which high values, preferably maximum values occur, such as at 11 and 11A. These extreme actual values are supplied to the closed loop control unit 3 where the above mentioned comparing takes place in the comparator 3B. If deviations between the rated and actual values occur, the unit 3 calculates the point of time and the size of the brake force that must be applied by the brake motor M at that point of time for the next following weft thread insertion. Thus, an optimal adaptation of the weft thread brake force to the varying characteristics of the occurring weft thread tension forces as caused by yarn specific values is achieved and the time and size of the brake force application is precisely controlled in accordance with such yarn specific values.

Although the invention has been described with reference to specific example embodiments, it will be appreciated that it is intended to cover all modifications and equivalents within the scope of the appended claims.

What is claimed is:

1. A weft thread brake for a loom, comprising brake force application members (1A, 1B) forming a thread gap for the passage of a weft thread (10) through said thread gap, a brake force control motor (M) connected to at least one of said brake force application members for controlling a brake force, a programmable closed loop control unit (3) connected to said control motor, an input-output unit (9) connected to said programmable closed loop control unit (3), a thread tension sensor (2) arranged downstream of said brake force application members (1A, 1B) as viewed in a weft thread travel direction and connected to said programmable closed loop control unit (3) for supplying an actual thread tension signal to said programmable closed loop control unit (3) to control said brake force by a brake force control signal in dependence on said actual thread tension signal, wherein said programmable closed loop control unit (3) comprises a memory (3A) connected to said input-output unit (9) for storing in said memory rated yarn specific weft thread tension values which are taken into account by said control unit (3) in producing said brake force control signal, and wherein said programmable closed loop control unit (3) further comprises a signal comparator (3B) connected to said thread tension sensor for receiving said actual thread tension signal and connected to said memory (3A) for receiving said rated yarn specific weft thread tension values for producing said brake force control signal as a function of one of an insertion time t of a weft thread into a loom shed and an angular rotation of a main loom drive shaft, to determine the time and size of a brake force application.

2. The weft thread brake of claim 1, wherein said comparator is adapted to produce from said rated yarn specific weft thread tension values and from said actual thread tension signal an output signal that determines said time as a starting point for an application of said brake force control signal and a brake stroke in accordance with said size of said brake force to be applied by said brake force application members (1A, 1B) to vary said thread gap.

3. The weft thread brake of claim 1, wherein said programmable closed loop control unit comprises a circuit connected to said thread tension sensor (2) for producing a weft monitoring signal based on the absence of said actual thread tension signal, whereby said thread brake can be used as a weft stop motion.

4. The weft thread brake of claim 1, wherein said input-output unit has a display (9A) for displaying information.

* * * * *

UNITED STATES PATENT AND TRADEMARK OFFICE

CERTIFICATE OF CORRECTION

PATENT NO. : 5,476,122

DATED : Dec. 19, 1995

INVENTOR(S) : Schuster et al.

It is certified that error appears in the above-identified patent and that said Letters Patent is hereby corrected as shown below:

Column 1, line 46, replace "EPO 475,892 A1" by -- EP 0,475,892 A1--;

Column 2, line 4, replace "other" by --over--;

Column 3, line 32, replace "weft brake" by --weft break--;

Column 4, line 18, replace "thee" by --the--;

Column 4, line 36, replace "the weft" by --a weft--;

Column 4, line 37, replace "a degree" by --the degree--.

Signed and Sealed this

Seventh Day of May, 1996

Bruce Lehman

*Attest:*

BRUCE LEHMAN

*Attesting Officer*

*Commissioner of Patents and Trademarks*